United States Patent [19]

Elson et al.

[11] Patent Number: 4,460,045

[45] Date of Patent: Jul. 17, 1984

[54] FOAM GRAVEL PACKING IN HIGHLY DEVIATED WELLS

[75] Inventors: Thomas D. Elson, Chino; Ralph S. Millhone, Brea, both of Calif.

[73] Assignee: Chevron Research Company, San Francisco, Calif.

[21] Appl. No.: 395,201

[22] Filed: Jul. 6, 1982

[51] Int. Cl.[3] ..... E21B 43/04

[52] U.S. Cl. ..... 166/278; 166/309

[58] Field of Search ..... 166/51, 276, 278, 309

[56] References Cited

U.S. PATENT DOCUMENTS

| | | | |
|---|---|---|---|
| 3,530,940 | 9/1970 | Dauben et al. | 166/309 |
| 3,583,483 | 6/1971 | Foote | 166/250 |
| 3,587,740 | 6/1971 | Gerwick et al. | 166/278 |
| 3,603,398 | 9/1971 | Hutchinson | 166/278 |
| 3,963,076 | 6/1976 | Winslow | 166/51 |
| 3,999,608 | 12/1976 | Smith | 166/51 |
| 4,119,150 | 10/1978 | Froelich | 166/276 |

*Primary Examiner*—James A. Leppink
*Assistant Examiner*—William P. Neuder
*Attorney, Agent, or Firm*—G. W. Wasson; Lewis S. Gruber; Edward J. Keeling

[57] ABSTRACT

A method for packing particulate material in the annulus surrounding a liner in a subsurface well having a substantial deviation from vertical. Foam carrier fluid is employed for placing the particulate material. The geometry of the apparatus at the location where the material is to be placed is described.

12 Claims, 11 Drawing Figures

FOAM GRAVEL PACKING IN HIGHLY DEVIATED WELLS

BACKGROUND OF THE INVENTION

1. Field of the Invention

This invention relates to methods of completing deviated wells such as oil, gas, condensate, water, or geothermal wells wherein particulated material, such as gravel, is positioned within a casing or in a well bore against a permeable incompetent formation to minimize the migration of sand and other granular material from the formation into the well when fluids are subsequently produced from the formation. More particularly, the invention relates to an improved method for transporting the gravel material to and placing it in a desired location in the casing or well bore.

2. Description of the Prior Art

The technique of "gravel packing" to restrict the passage of sand or other particulate matter from a subterranean formation into a well penetrating the formation is well known, particularly in the art of oil and gas production. Gravel packing basically consists of mixing a selected size-grading of gravel, sand or other particulate material in a fluid carrier, such as fresh water, brine, oil, or gas, and pumping the resulting slurry down the annulus between the well bore wall or a perforated casing and a centrally located well screen or interior perforated liner. The fluid carrier filters through the screen and is returned to the surface leaving a porous permeable "pack" of granular material between the wall of the well bore or the casing and the well screen. This porous pack substantially reduces the migration of particles from the formation into the well thus avoiding the attendant problems of equipment erosion and well bore plugging when fluids are produced from the formation.

Similarly, the particulate matter may be placed in a well bore against a permeable incompetent formation without placement of a liner. In another variation, once the particulate matter is placed in the well bore, it may be consolidated with plastic or other consolidating materials according to well known techniques. It can be seen that the success of all these operations involving placing particulate matter in a well against a perforated casing or a subterranean formation, referred to generally as "gravel packing," lies in the establishment of a complete packing of the gravel in the annulus or well bore so as not to present unpacked voids while establishing a highly permeable pack so that fluids can easily pass through the pack.

Prior art gravel packing techniques have been directed to the selection of the gravel material to be placed in the well bore pack and to the carrier fluid used in placing the gravel. Those techniques have disclosed sizing the gravel to the formation particle size analysis and have described the physical and economic effects of high and low gravel concentration slurries used in placing the gravel as a downhole gravel pack.

Other prior art patents and publications have discussed packing gravel in wells that are deviated from vertical; that is, wells which are angled away from vertical toward horizontal. These prior art patents and publications have discussed placing gravel in water and viscous carrier liquids and have shown the effects that can be expected with variations in viscosity, flowrate and leakoff of carrier fluid, well bore geometry, and gravity settling of the pack gravel.

In a copending application of T. D. Elson and R. S. Millhone, Ser. No. 323,787, filed Nov. 23, 1981 for Foam Gravel Packing, a method and apparatus is described for fluidizing gravel in a stable foam carrier fluid and for placing the gravel as a subsurface well bore gravel pack. That application describes techniques for placing such a gravel pack in substantially vertical well bores. The apparatus and method disclosed in that patent application are incorporated herein by reference.

OBJECTS OF THE PRESENT INVENTION

The object of the present invention is a method for accomplishing the placement of particulate material or a gravel pack in a deviated well bore in a manner that will insure successful and efficient transportation of the gravel to the well bore pack site and will prevent voids in the gravel pack within the well.

Another object is a method for transporting gravel pack material to a gravel pack site in a carrier fluid that will transport the gravel and not damage the formation along the well bore.

Another object of the method is to remove the gravel from the carrier fluid at the gravel pack site in a manner that produces a substantially complete permeable gravel pack that will permit formation or injection fluids to flow through the pack.

Further objects and features of the present invention will be readily apparent to those skilled in the art from the appended drawings and specification illustrating a preferred embodiment wherein.

Figure 1:
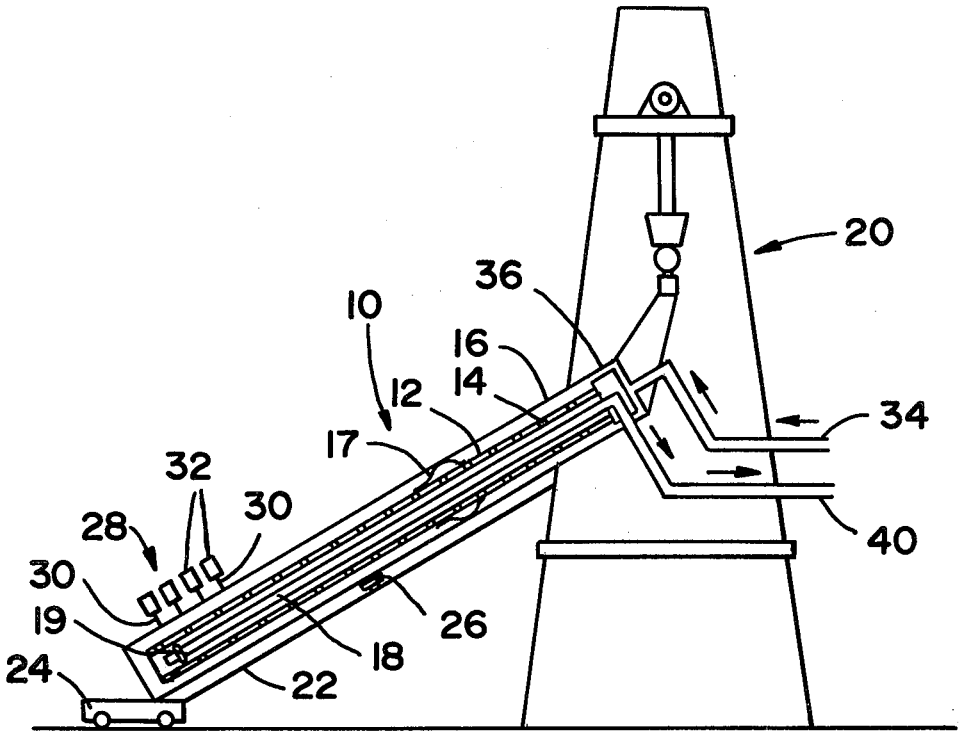
FIG. 1 is a partially schematic elevational view of apparatus used to demonstrate the present invention.

Successful sand control in deviated wells has become more important with the continuing increase in offshore drilling. Large oil and gas fields are being produced via directional wells from central platforms in deeper waters. Many of these wells penetrate formations at high angles. Gravel packing, the most common and effective well completion for sand control, is not commonplace or routinely successful in these highly deviated wells. Gravel packing of deviated wells is more difficult than packing near-vertical wells simply due to the influence of gravity. In high angle holes, gravel tends to dune in the upper end of the well bore and bridge off the annulus, causing a premature sandout. The unpacked interval below the dune can lead to failure of the well completion.

Studies have used a full-scale model well bore to examine the gravel placement process in highly deviated wells. Although many of the same characteristics of vertical well packing occur in deviated wells, the change in well bore angle affects the gravel packing operation significantly.

BACKGROUND

Several other investigators have studied gravel packing with well models. In their experiments using a water carrier fluid, gravel formed a dune and packed from the top of the deviated well downward when the deviation was >45°; but in more-vertical wells (<45°), the gravel packed from the bottom up. For successful top-down packing the carrier fluid had to flow over the dune continuously and with adequate velocity. If enough fluid escaped through the gravel and into the liner to sufficiently reduce the velocity over the dune, the annulus would bridge, resulting in an incomplete pack.

Other experimenters (Maly, Robinson and Laurie "New Gravel Packing Tool for Improving Pack Placement" Journal Petroleum Technology, January 1974) found that the final dune length was affected by variables such as liner slot size, gravel concentration and flow rate. They anticipated that liner slot plugging, carrier fluid viscosity and flowrate would also affect dune length. Packing efficiency of deviated wells was improved by placing a number of deformable baffles at regular intervals along the tail-pipe. These baffles helped to maintain flow in the channel over the dune by restricting flow in the liner-tailpipe annulus. However, factors such as the pressure drop needed to deform the baffles and baffle spacing were critical.

Observations of scaled model experiments has shown that in wells deviated ≧45° incomplete packing results, without special considerations. Gravel, carried by either low or high viscosity fluids, will bridge unless the design variables are properly selected. Packing efficiency increased with (1) decreasing gravel concentration, (2) decreasing particle diameter, (3) decreasing particle density, (4) increasing fluid density and/or viscosity, (5) increasing flowrate and (6) increasing resistance to flow in the liner-tailpipe annulus. These observations showed the resistance to flow in the tailpipe annulus to be the most important factor for successful and full packs. One solution was to use a larger-diameter tailpipe inside the liner. Packing efficiency dramatically increased when the ratio of tailpipe O.D. to liner I.D. was greater than 0.6.

Foam, as used in the petroleum industry (drilling, fracturing, cleanout), has the following characteristics: (1) very low density, (2) high apparent viscosity, (3) low leakoff, (4) high solids carrying (or lifting) capacity, and (5) low formation damage potential. Applications are generally in situations where low pressure is encountered resulting in severe losses of conventional fluids or when a well bore penetrates a formation sensitive to liquid, e.g., liquid reacts with sensitive clays or liquid adversely affects relative permeability to oil or gas. Fluid loss control represents the main advantage to using foam over conventional fluids in drilling and cleanout operations. For the same reason foam has potential application in gravel packing operations.

A series of experiments were designed and performed by the present inventors to determine the packing characteristic of a foam carrier system in highly deviated wells. They were run in a full-scale, transparent model well bore which could be deviated up to 90° from vertical.

Gravel packing experiments in the same model using conventional carrier fluids were used for relative comparison of the performance of the foam carrier system. Characteristics of conventional gravel pack placement used for comparison included fractional gravel fill based on the theoretical volume of the casing-liner annulus, gravel carrying capacity, after pack settling, plugging of slots or wire-wrapped openings in the liner, and pack porosity and permeability.

Besides well bore angle, well bore geometry and foam quality were varied. Variations of well bore geometry consisted primarily of tailpipe size and positioning. Liquid volume fraction (LVF) of foam carriers ranged from wet (LVF≃0.25) to dry (LVF≦0.05). In one experiment, a dry foam was stabilized with a cross-linked HEC (hydroxyethyl cellulose) polymer.

FIG. 1 is a schematic drawing of the full-scale model well bore 10 used for the foam gravel packing experiments. It consisted of a 5 in. O.D. liner 12 having slots 14 (0.030 in.×2 in.) inside of an 11 in. I.D. acrylic casing 16. A tailpipe 18 was positioned inside the slotted liner 12 to take returns. The liner is centralized within the casing by centralizers 17, preferably along the entire well bore but at least at the zone to be packed. Baffles 19 may be installed in the annulus between the outside of the tailpipe 18 and the inside of the slotted liner 12. The model hung in a derrick 20. FIG. 1 shows the well bore 10 when used for the angled well studies. An I-beam support assembly 22 and a cart 24 allowed well deviation angles of 0° to 90° from vertical. TV cameras 26 movably positioned alongside the model well bore 10 recorded the gravel packing operation.

Four simulated perforations 28 allowed study of perforation packing. The simulated perforation consisted of tunnels 30 into the casing 16 opening into transparent cylinders 32 having a limited volume.

Foam carriers with gravel material were introduced from injection conduit 34 through cross-over 36 into the annulus between the slotted liner 12 and the casing 16. Returns entered the tailpipe 18 and moved upwardly through the well to returns line 40. Foam was produced using a foam generator similar to those used in cleanout operations. Reference should be had to U.S. Pat. No. 3,583,483, issued June 8, 1971 to Robert W. Foote for "Method For Using Foam In Wells," assigned to the same assignee as the present application, for a disclosure of the effectiveness of improved foams having high-lifting capability for use in wells by controlling the liquid volume/gas volume ratio (LVF) of the foam to a desired value.

Figure 2:
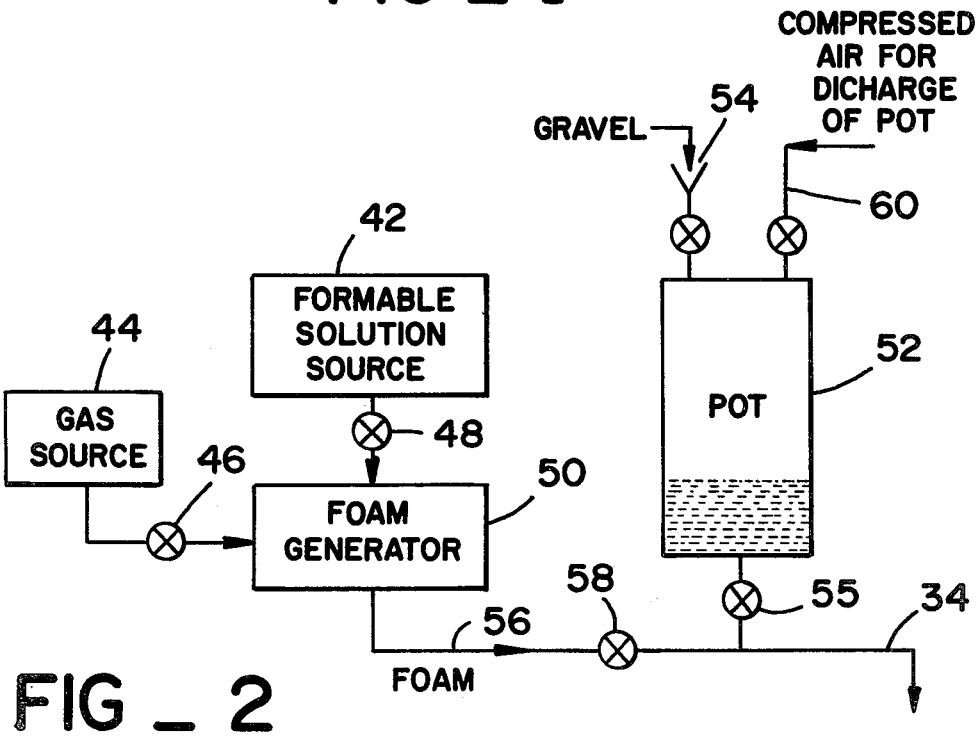
FIG. 2 is a block diagram illustrating elements used to produce a fluidized foam/gravel mixture for injection into a well bore.

In the FIG. 2 schematic portion, conventional foamable solution source 42 and gas source 44 are connected through valves 46 and 48 to a foam generator 50 where a foam of the desired consistency is formed.

A gravel pot 52 was used to hold gravel introduced through port 54 and to discharge a fluidized foam-gravel mixture through valve 55 into injection line 34. Optimum displacement occurred when the gravel was first fluidized with foam. The gravel is fluidized in the pot 52 by foam introduced through line 56, valve 58 and valve 55. The foam-gravel mixture is then displaced by a compressed gas introduced at port 60 at pressure greater than that in the injection line 34.

A 10–16 U.S. mesh, Heart of Texas gravel was used for all experiments and foam was generated using 90 to 120 SCFM of air.

FIGS. 3–9 illustrate the effects of different well bore hardware geometry and, in some cases, different carrier fluids as observed from tests conducted in the model well bore illustrated in FIG. 1. Each of the tests were conducted on modeled well bores having an 80° angle from vertical.

Figure 3:
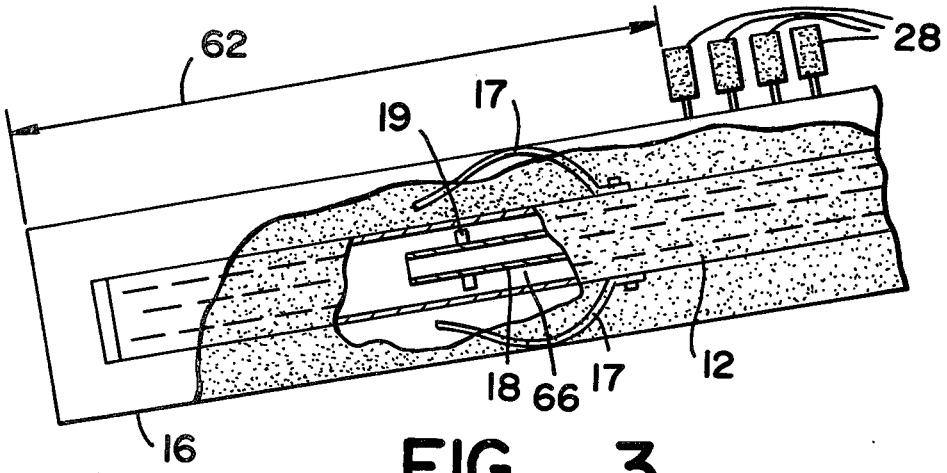
FIGS. 3–8 are illustrations, partially in section, of actual gravel packs observed with the apparatus of FIG. 1 showing the effects of variations in well bore geometry and carrier fluids on the placed gravel pack.

The FIG. 3 test was run with a 2-in. tailpipe 18 set 8 ft. from the bottom of the model, and a "rathole" of several feet. "Rathole" is the term used by those working with wells to designate the portion of the well bore below the perforations to the bottom of the well. FIG. 3 shows that the final pack was incomplete. Due to the high position of tailpipe 18, no gravel reached to the bottom of the well bore. For this test foam quality was very high during placement (LVF<0.02) to the point where air slugging was observed as the gravel was placed. In spite of the poor completion design and slug flow, the foam system demonstrated improved placement characteristics compared to water and slurry packing under similar conditions. Gravel was carried nearly to the tailpipe end position before settling downward.

Figure 4:
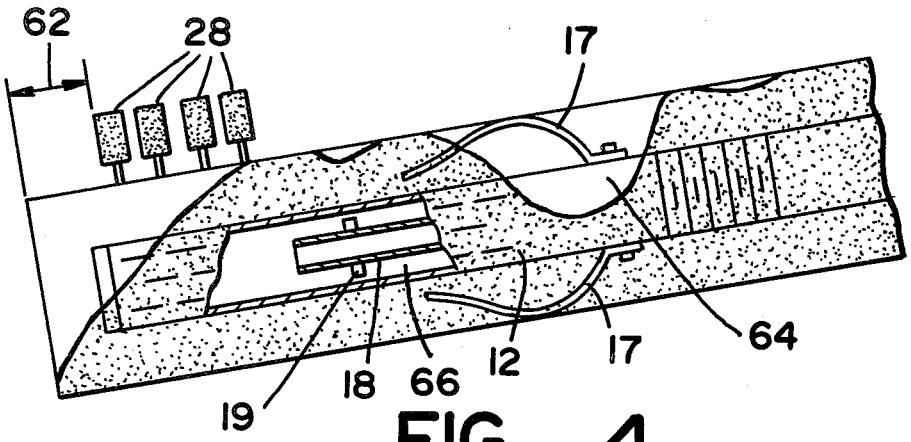

In the FIG. 4 test, the model configuration was changed to create an upper telltale 64 by using a wire wrapped screen separated from the main liner by a section of blank pipe. FIG. 4 shows this configuration and the final pack observed. Foam quality was maintained to eliminate slugging and improved transport through the model well bore was observed. However, similar to the FIG. 3 test, an incomplete pack occurred. The foam carrier had the appearance of being similar to viscous water as a carrier, but did not result in after pack settling which limits use of slurry packs in high angle holes. As with other viscous carrier tests, poor packing was observed around the blank pipe in this upper telltale design.

For both FIG. 3 and FIG. 4 tests, complete packing in the perforations 28 was noted.

Figure 5:
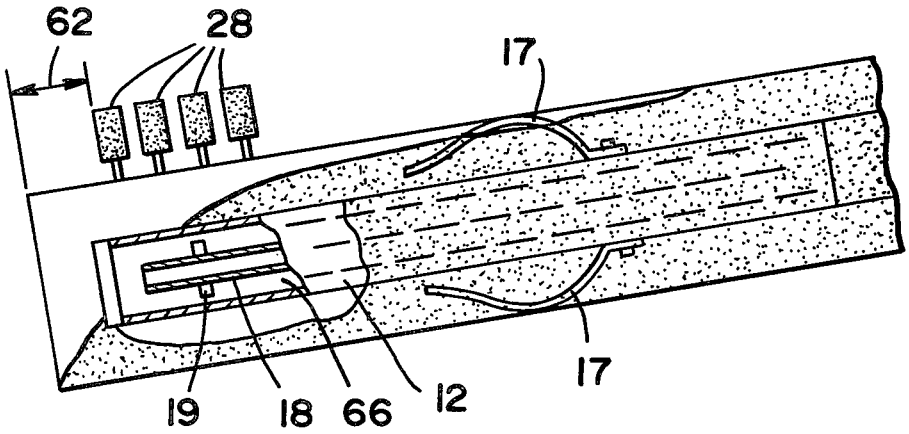

The FIG. 5 test was a repeat of the FIG. 4 test with the upper telltale eliminated and slotted pipe run through the complete model. By eliminating the blank pipe, it was thought that a more complete fill would be obtained. This turned out not to be the case, as shown in FIG. 5. It was concluded that due to significant flow of foam in the inner annulus 66 (between the 2 in. tailpipe and the 5-in. slotted liner), carrier fluid velocity in the casing-liner annulus was too low to eliminate gravel settling and a premature sandout.

Figure 6:
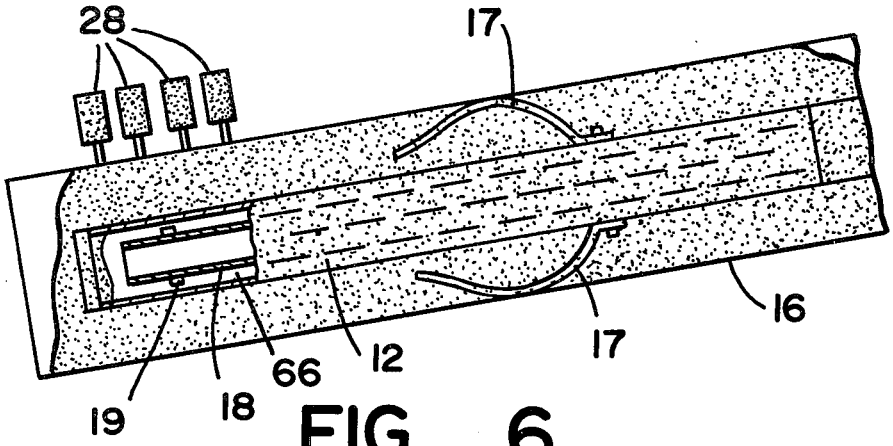

For the FIG. 6 test, a 3-in. tailpipe 18 was used to minimize flow in the inner (tailpipe-liner) annulus 66 which adversely affected the packs in the FIGS. 3, 4 and 5 tests. With a high foam quality (LVF approximately 0.05), a complete pack was obtained with this new configuration. A final pack porosity was calculated to be 41.6%.

Figure 7:
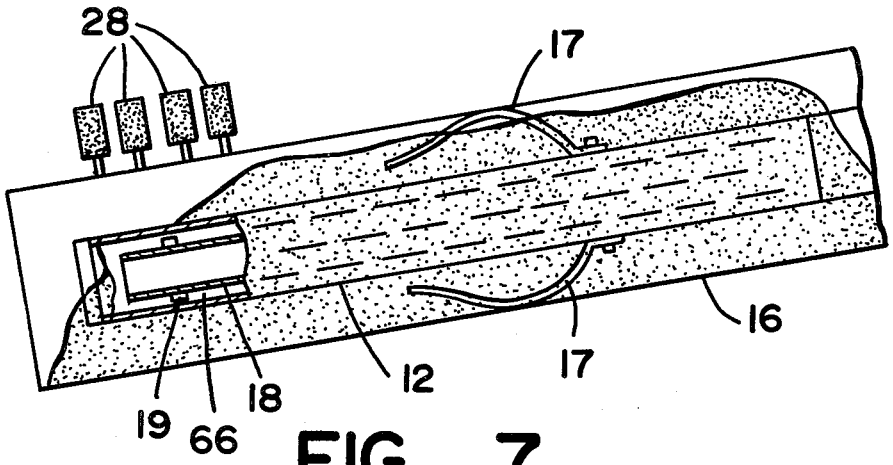

The FIG. 7 test was a repeat of the FIG. 6 test using a wet instead of dry foam (LVF approximately 0.22 vs 0.05). FIG. 7 shows the result was an incomplete pack. During placement, significant duning was observed and many characteristics were similar to low viscosity water carrier tests.

Figure 8:
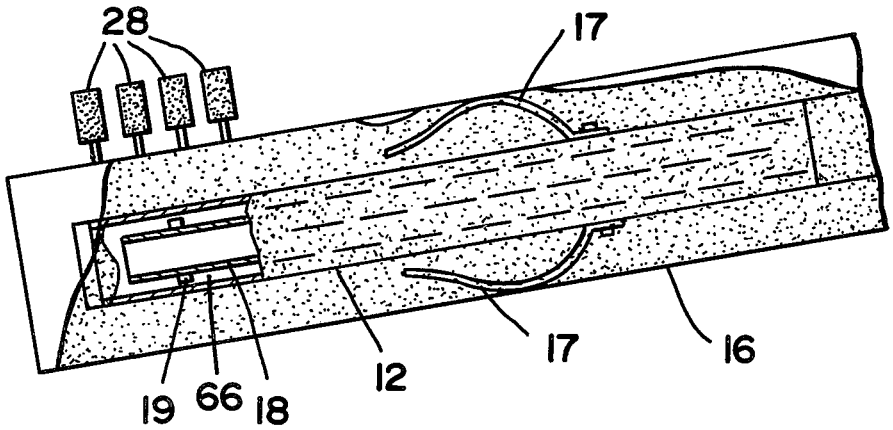

In the FIG. 8 test, a dry (LVF approximately 0.06) polymer stabilized foam carrier was used with the same model configuration as the tests of FIGS. 6 and 7. Water used in the foam was viscosified with a cross-linked polymer. The proposed advantage of this system was reduced gravel settling and duning. A more effective downward movement of gravel was noted with the stabilized foam resulting in a complete pack with a porosity of 41.0%.

Figure 9A:
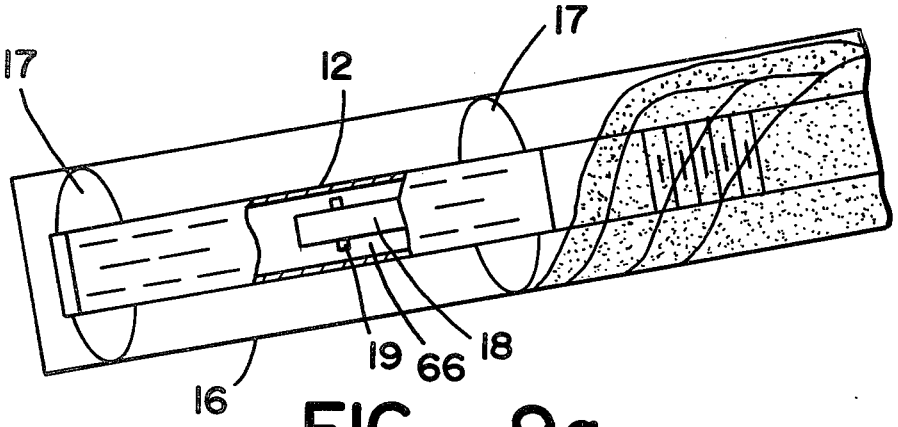
FIGS. 9A, 9B and 9C are illustrations, partially in section, of actual gravel packs produced with the apparatus of FIG. 1 with different carrier fluids.
Figure 9B:
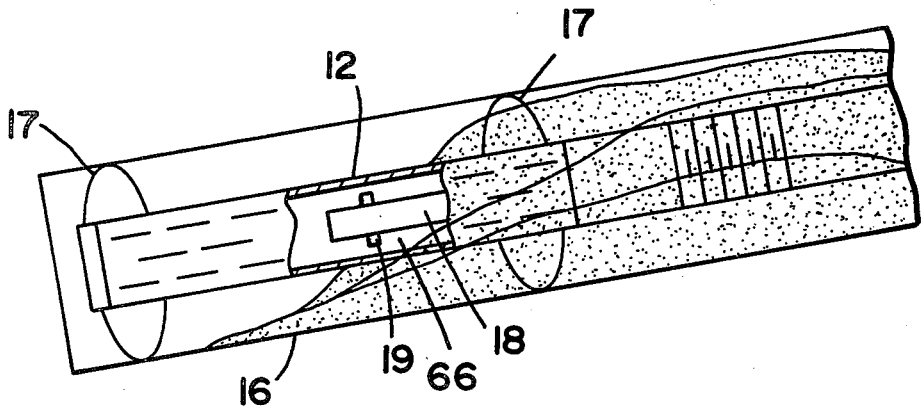
Figure 9C:
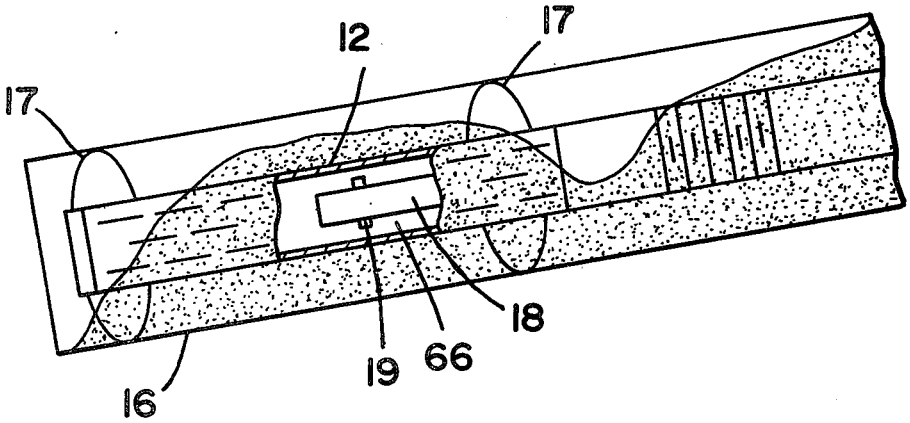

FIGS. 9(*a*), (*b*) and (*c*) illustrate tests conducted with the model well equipment and show a comparison of gravel placement in a well with an upper telltale design and a 2-inch tailpipe. FIG. 9(*a*) illustrates placement of gravel with a water carrier, FIG. 9(*b*) illustrates placement of gravel with viscous water (HEC solution) and FIG. 9(*c*) illustrates placement of gravel with foam (the test described and illustrated with regard to FIG. 4). The increase in gravel fill shown in FIG. 9(*c*) with the dry foam carrier demonstrates the superior suspending capability of foam as compared to water or viscous water.

DISCUSSION OF RESULTS

Table 1 summarizes results from the well foam gravel packing experiments. For all of the experiments an average LVF was estimated for the time in which gravel was being placed in the well bore. It was observed that for LVF's of 0.02 and less, slug flow would occur. The LVF's listed are at model pressure.

Pack porosity is an indication of gravel pack tightness. For example, if a 10–20 U.S. mesh Heart of Texas gravel were simply poured into an air-filled container (or well bore), the porosity of the gravel would be approximately 45%. The tightest packing arrangement of the grains (accomplished by pouring slowly and tamping the container) would result in a pack with a porosity of 35%. The results of the foam gravel packing experiments fell between these two extremes.

When possible, perforation porosity was measured. For the angled well tests, the perforations were located on top of the casing pointing upward. The values shown in Table 1 indicate that perforations are packed more loosely than the well bore annulus.

Because one advantage of using foam in workover or gravel packing operations is its low formation damage potential, the total amount of liquid used in each experiment was estimated and is shown in Table 1. For comparison, 200–250 bbl of water would be used to pack the 45 ft. well bore and 20–30 bbl for a viscous carrier.

Gravel packing a well bore deviated from vertical requires special design considerations focusing primarily on maintaining flow and velocity of the gravel slurry in the casing-liner annulus. Diversion of carrier fluid into the inner (tailpipe-liner) annulus lowers the velocity of the slurry in the outer (casing-liner) annulus which leads to gravel settling, duning and early bridge-off in the outer annulus.

Methods to achieve a successful pack using conventional fluids have included using large diameter or baffled tailpipes to restrict flow in the inner (tailpipe-liner) annulus. Using a large diameter tailpipe resulted in packs above 90% theoretical fill. The FIG. 4 test investigated whether foam could successfully pack the well bore without special designs. As indicated in Table 1 and FIG. 4 this did not occur even though there was significant improvement over the conventional fluids using the same well bore configuration, see FIG. 9. The increase in gravel fill with the dry foam carrier demonstrates its superior suspending capability. In spite of this improvement though, a restricted tailpipe-liner annulus was recommended to fully gravel-pack the angled well bore.

For the FIGS. 6 and 8 tests, success was achieved with dry foam and a 3-in. tailpipe giving a tailpipe O.D. to liner I.D. ratio of 0.82. Despite using the same diameter ratio in the FIG. 7 test, an incomplete pack occurred due to gravel settling and duning associated with the wet foam carrier (LVF≈0.23). For the FIGS. 3, 4 and 5, a 2-in. tailpipe was used (tailpipe O.D./liner I.D.=0.56) and incomplete packs were obtained.

Use of a stabilized foam such as in the FIG. 8 test may have advantages in long, deviated wells and/or when high bottom hole pressures reduce the LVF to a less than optimum value. This is based on comparative observations made during the FIGS. 6 and 8 tests which showed that the stabilized foam had superior suspension capability.

TABLE 1

SUMMARY OF RESULTS - ANGLED TESTS

| FIG. | Average LVF | Pack Porosity, % | Average Perforation Porosity % | Fraction Theoretical Fill | Total Liquid, BBl | Comments |
|---|---|---|---|---|---|---|
| 3 | 0.021 | N/A | N/A | 0.65–0.75 | 13 | Poor Well Bore/Completion Design |
| 4 | 0.031 | N/A | 44.4 | 0.83 | 15 | Upper Telltale Design for Comparison w/Conventional Placement Experiments |
| 5 | 0.045 | N/A | 43.1 | 0.81 | 11 | Slotted Liner through Complete Model |
| 6 | 0.062 | 41.6 | 42.6 | 0.99 | 18 | Restricted Tailpipe-Liner Annulus |
| 7 | 0.23 | N/A | 43.3 | 0.83 | 49 | Restricted Tailpipe-Liner Annulus |
| 8 | 0.087 | 41.0 | 44.4 | 0.93 | 15 | Polymer Stabilized Foam; Restricted Tailpipe-Liner Annulus |

N/A = Not available

While certain preferred embodiments have been specifically disclosed in describing the present invention, it should be understood that the invention is not limited thereto as many variations will be readily apparent to those skilled in the art and the invention is to be given its broadest possible interpretation within the terms of the following claims.

What is claimed is:

1. A method for packing particulate material in the annulus surrounding a liner having production perforations therethrough positioned in a subsurface well bore having substantial deviation from vertical comprising the steps of:

(a) positioning said liner in said subsurface well bore having substantial deviation from the vertical adjacent to said subsurface to be packed near the end of a well bore conductor and centralizing said liner in said well bore, (b) generating at the earth's surface a relatively dry stable foam material having a liquid volume fraction between 0.02 and 0.2, (c) fluidizing said particulate material with said stable foam, (d) forcing said fluidized foam-particulate mixture down said well bore conductor and into said annulus surrounding said liner, (e) causing said particulate material of said foam-particulate mixture to be retained in said annulus beginning at or substantially near the downhole end of said liner, (f) moving said foam of said foam-particulate mixture upwardly through the inside of said liner and said well bore.

2. The method of claim 1 wherein said foam has a liquid volume fraction of about 0.05.

3. The method of claim 1 wherein an inner conductor is placed within said liner and said foam of said foam-particulate mixture is moved upwardly through said inner conductor from said downhole end of said liner.

4. The method of claim 3 wherein said inner conductor has an outside diameter measurement which is at least 80% of the inside diameter of said liner.

5. The method of claim 1 wherein a liquid volume fraction characteristic of said foam is established for temperature and pressure conditions existing in said subsurface well bore where said particulate material is to be packed.

6. The method of claim 1 wherein the foam-particulate mixture in the annulus surrounding said liner is maintained in flow and velocity toward said downhole end of said liner prior to retaining said particulate material in said annulus.

7. The method of claim 1 wherein foam separated from said foam-particulate mixture is preferentially moved upwardly through the inside of said liner from the deepest vertical end of said annulus surrounding said liner and restricted from movement through said production perforations in said liner above said deepest vertical end.

8. The method of claim 1 wherein a tail pipe is inserted inside said liner and moving of said foam of said foam-particulate material is upward through said tail pipe from the end thereof adjacent to the deepest vertical end of said annulus surrounding said liner.

9. The method of claim 8 wherein the inner annulus between said tail pipe and the inside of said liner is so constructed and arranged as to restrict foam moving through said inner annulus.

10. The method of claim 1 wherein the foam is stabilized by adding a viscosifying agent thereto.

11. The method of claim 10 wherein the viscosifying agent is a polymer.

12. A method for reducing particulate material settling and duning in packing particulate material in an annulus surrounding a centralized liner positioned in a subsurface well bore deviated more than 60° from vertical comprising:

(a) suspending said particulate material in a dry stable foam having a liquid volume fraction between 0.02 and 0.2 to create a foam-particulate mixture, (b) flowing said foam-particulate mixture into said annulus within said well bore deviated more than 60° from vertical at a flow rate and velocity to maintain mixture flow toward the deepest vertical end of said annulus, (c) separating said foam from said foam-particulate mixture, beginning at said deepest vertical end of said annulus, and (d) moving said separated foam upward through the inside of said liner.

* * * * *